US007748356B2

(12) United States Patent
Meyer et al.

(10) Patent No.: US 7,748,356 B2
(45) Date of Patent: Jul. 6, 2010

(54) VALVE TRAIN FOR INTERNAL COMBUSTION ENGINES

(75) Inventors: Markus Meyer, Mildenau (DE); Erik Schneider, Chemnitz (DE); Lutz Stiegler, Kändler (DE); Andreas Werler, Zwickau (DE); Jörg Wutzler, Zwickau (DE)

(73) Assignee: IAV GmbH Ingenieurgesellschaft Auto und Verkehr, Berlin (DE)

( * ) Notice: Subject to any disclaimer, the term of this patent is extended or adjusted under 35 U.S.C. 154(b) by 132 days.

(21) Appl. No.: 11/662,447

(22) PCT Filed: Feb. 24, 2006

(86) PCT No.: PCT/DE2006/000360

§ 371 (c)(1),
(2), (4) Date: May 9, 2007

(87) PCT Pub. No.: WO2006/136125

PCT Pub. Date: Dec. 28, 2006

(65) Prior Publication Data

US 2008/0017146 A1 Jan. 24, 2008

(30) Foreign Application Priority Data

Jun. 17, 2005 (DE) ..... 10 2005 028 542
Sep. 2, 2005 (DE) ..... 10 2005 042 258

(51) Int. Cl.
*F01L 1/34* (2006.01)

(52) U.S. Cl. ..... 123/90.16; 123/90.2; 123/90.39; 123/90.44

(58) Field of Classification Search ..... 123/90.15, 123/90.16, 90.17, 90.18, 90.2, 90.27, 90.31, 123/90.39, 90.44
See application file for complete search history.

(56) References Cited

U.S. PATENT DOCUMENTS 4,572,118 A 2/1986 Baguena
6,659,053 B1 12/2003 Cecur (Continued)

FOREIGN PATENT DOCUMENTS

DE 22 56 185 A1 5/1974

(Continued)

OTHER PUBLICATIONS

International Search Report.

*Primary Examiner*—Ching Chang
(74) *Attorney, Agent, or Firm*—Collard & Roe, P.C.

(57) ABSTRACT

The invention relates to a valve train for internal combustion engines, comprising a camshaft and valve actuation elements for one or more valves, the elements being located in the cylinder head. The aim of the invention is to provide a valve train for an internal combustion engine, with which a reliable stroke adjustment of the valves can be made, without the need for complex technical resources, while at the same time allowing a forward or rear displacement of the valve orifice region. To achieve this, in order to modify the valve stroke curve, the contact point between the transfer member and the cam can be displaced along the periphery of the cam and the contact point between the transfer member and a control curve of the support body can be displaced, forcing the part of the transfer member that interacts with the cam to be guided, by shifting the transfer member in relation to the camshaft.

23 Claims, 3 Drawing Sheets

Figure 2:
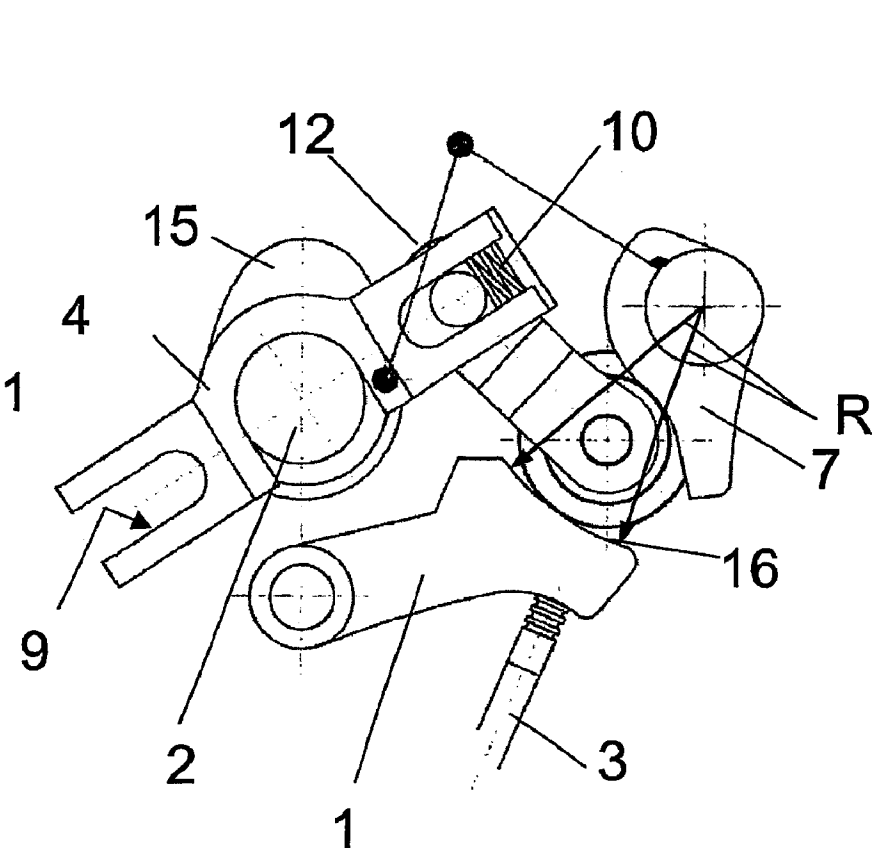

U.S. PATENT DOCUMENTS 7,222,596 B2 * 5/2007 Stiegler ..... 123/90.16

FOREIGN PATENT DOCUMENTS

DE 42 20 816 A1 1/1994
DE 100 31 783 A1 1/2002
DE 100 61 618 B4 6/2002
DE 103 20 324 A1 7/2004
DE 103 07 654 A1 9/2004
DE 103 41 702 A1 4/2005
EP 0 717 174 A 6/1996

* cited by examiner

VALVE TRAIN FOR INTERNAL COMBUSTION ENGINES

CROSS REFERENCE TO RELATED APPLICATIONS

Applicants claim priority under 35 U.S.C. §119 of German Application No. 10 2005 028 542.2 filed Jun. 17, 2005 and German Application No. 10 2005 042 258.6 filed Sep. 2, 2005. Applicants also claim priority under 35 U.S.C. §365 of PCT/DE2006/000360 filed Feb. 24, 2006. The international application under PCT article 21(2) was not published in English.

The invention relates to a valve train for internal combustion engines having a camshaft with the features stated in the preamble of Patent claim 1.

Previously known from DE 22 56 185 A1 is a variable valve train for internal combustion engines having an intermediate lever which is articulatedly connected to a guide rocker which is articulatedly coupled in a pivotable fashion to the cylinder head and is subjected to the action of a spring. Said intermediate element pivots about its axis of articulation on the guide rocker between a pivotably mounted support body, which determines the lift magnitude by means of its pivoting position, and the end face of the shank of a valve which is to be actuated and is held in a closed position under the action of a spring or is opened by means of the intermediate lever.

Also previously known, from DE 100 31 783 A1, is a variable valve train for internal combustion engines having a valve arrangement, said valve arrangement being moved indirectly by a cam via a rocking or tilting lever which is pivotably mounted directly or indirectly on the cylinder head, and having one or more valves which close under the action of a spring. The rocking or tilting lever is in engagement with an intermediate lever which is guided so as to be moveable in a rocking fashion, with said intermediate lever also being in sliding or rolling engagement at one side with the cam of a camshaft and at the other side with a control curve of a support body which is rotatably mounted directly or indirectly on the cylinder head. The support body determines, by means of its position and the resulting effective region of a control curve, the magnitude of the valve lift, with it being possible for the angular position of the support body to be set by means of a suitable controller and a corresponding actuator.

Likewise previously known, from U.S. Pat. No. 4,572,118, are variable valve trains for internal combustion engines having an intermediate lever which is articulatedly connected to a crank. Said intermediate lever is displaced between a pivotably mounted support body, which determines the lift magnitude by means of its pivoting position, and a rocking or tilting lever which is pivotably mounted directly or indirectly on the cylinder head. Here, the rocking or tilting lever opens one or more valves which close under spring force. The intermediate lever is in engagement here with in each case one circular-arc-shaped contour, with the support body and with the rocking or tilting lever. The special feature is that both circular-arc-shaped contours have a common central point. It is possible to see in particular from FIG. 20 a valve train for actuating the valves with variable valve lift curves, in which the rocking or tilting lever is in force-fitting engagement with an intermediate lever which is guided on the cylinder head and is also held in sliding or rolling engagement with the cam of a camshaft and with a control curve of a support body which is rotatably mounted directly or indirectly on the cylinder head.

Previously known from DE 100 61 618 B4 is a device for variably actuating valves by means of cams. Said device is arranged in a cylinder head with a camshaft which is mounted in a positionally fixed fashion, with valves which close under spring force and together with in each case one lift transmitting arrangement which is assigned to each of the valves and is guided in a positionally fixed manner in the cylinder head. An element which is adjustable in order to set the valve lift is arranged in the cylinder head so as to be positionally fixed but rotatably mounted. Said element has in each case one support curve and one control curve which run in series in an axial plane. An intermediate member is prismatically supported in a force-fitting manner both on the support curve and on the control curve of the element, which is variable in terms of position, and is guided in a pivotable fashion, so as to slide on the two curves, during the lifting movement. In addition, the intermediate member is in engagement with one of the cams of the camshaft and a lift transmitting arrangement for a valve. The control curve determines, as a function of the pivoting position of the variable element during the lift of the cam, the movement path of the intermediate member and therefore the magnitude of the lift imparted by the lift transmitting arrangement to the valve.

The invention is based on the object of providing a valve train for an internal combustion engine with which an adjustment of the valve opening time and/or valve closing time in the early or late direction is carried out reliably and with little technical expenditure, with an adjustment of the valve lift height being simultaneously possible.

Said object is achieved according to the invention by means of the characterizing features of Patent claim 1.

A valve train for internal combustion engines having at least one camshaft and having valve actuating elements arranged in the cylinder head has valve actuating elements for one or more valves of each cylinder. The valve actuating elements can in each case be actuated by means of a pivoting lever, which is mounted in a directly or indirectly positionally fixed manner in the cylinder block or in the cylinder head, in each case by means of a transmission member which is guided on a support body, and are in indirect form-fitting and/or force-fitting engagement with a cam. In order to vary the valve lift curve, it is possible to adjust the contact point between the transmission member and the cam along the periphery of the cam, and at the same time the contact point between the transmission member and a control curve of the support body, by means of a common adjustment device. Here, the transmission member is positively guided at the cam side. The cam-side positive guidance of the transmission member is, according to a first variant, provided by means of a correspondingly designed guide which simultaneously functions as an adjustment device. By pivoting the guide about the camshaft, the position of the positive guidance of that part of the transmission member which is operatively connected to the cam is varied. For this purpose, a pivotable slotted link is arranged around the camshaft, which slotted link supports the guide, with the guide preferably being embodied as a longitudinally moveable receptacle for a pin which is fixedly connected to the transmission member, a roller or a sliding block.

According to a second variant, the cam-side positive guidance of the transmission member is provided by a guide rocker which is pivotably connected to the transmission member and is adjusted by means of an adjustment device, for example an eccentric, a displaceable pin or the like, which is arranged on said guide rocker. By displacing the guide rocker by means of the adjustment device, the position of the transmission member relative to the support body and to the cam of the camshaft is simultaneously adjusted, so that as the valve lift is varied, an automatic advancement or retardation of the valve opening range is likewise carried out, as in variant one. The adjustment device is adjusted by means of an actuating device.

As a result of the cam-side positive guidance of the transmission member by means of the arrangement of the slotted link which is pivotable about the camshaft or by means of the adjustable guide rocker which is arranged on the transmission member, on the one hand, the contact point and therefore the point of engagement between the transmission member and the cam is displaced along the periphery of the cam contour, and on the other hand, the transmission member is positively guided in the axial direction towards the camshaft, so that the point of engagement between the transmission member and the control curve of the support body is displaced. The control curve, which co-determines the valve opening, on the support body can be designed here in such a way that, by displacing the guide track, a variation of the lift height and a variation of the position of the valve opening time and/or valve closing time are simultaneously carried out.

The advantage of the solution is that it is possible for the valve opening time and/or valve closing time to be adjusted, and for the valve lift height to simultaneously be variably set, by means of the pivoting of the slotted link or the adjustment of the guide rocker and the associated positive guidance of the transmission member. As the slotted link is pivoted or the guide rocker is adjusted, the position of the guide relative to the cam and to the support curve is varied at the same time as the movement along the cam contour. The guide or the guide rocker serves to determine the movement path of the cam-side end of the transmission member. The transmission of the lift movement of the cam to the valve is therefore varied simultaneously by means of an adjustment of the slotted link or of the guide rocker. It is thereby possible to adjust the valve lift in terms of height and with regard to the opening time and closing time of the valve by means of an adjusting movement. The two variants presented are also distinguished by their simple design, a low spatial requirement and a reliable adjustment capability.

A further advantage of the solution according to the invention is that the valve opening time can be kept approximately constant while the closing time can be adjusted between early and late. The lift height of the valve lift curve is likewise variable here, with it also being possible to obtain an approximately constant valve lift height. This is advantageous in particular for the use of the valve train according to the invention for an inlet valve. When using the drive for an outlet valve, it is for example advantageous to keep the closing time of the outlet valve approximately constant while the opening time of the outlet valve is adjusted in the early or late directions. A variation of the valve lift can likewise be carried out here.

In one advantageous embodiment, the contact face, on which the roller which is in engagement with the control curve is supported, of the pivoting lever is formed in terms of its profile as a radius about the adjustment axis of the support body. This ensures harmonic shaping of the valve lift curves over the entire adjustment range.

According to variant one, the slotted link can be adjusted by means of a separate drive or by means of the pivoting of the support body by being coupled thereto. In a further embodiment, the support body is fixedly arranged in the housing, so that the lift adjustment is provided only by means of a displacement of the slotted link and therefore of the guide.

In a further embodiment, the support body can be simultaneously pivoted independently of the slotted link, as a result of which the valve lift curve can be set very flexibly with regard to lift height and opening and/or closing time.

In a further embodiment, the adjustment of the position of the cam-side guide of the transmission member and of the support curve takes place in a coupled fashion, so that both of the parameters which determine the valve lift curve can be adjusted with one adjusting movement. Here, the drive of the adjustment movement can be provided both by the slotted link which supports the guides and also by the support body.

According to variant two, the support body is fixedly arranged on the cylinder block. A complex mounting, and the associated adjustment device, for the support body is dispensed with in this way. Fewer forces are required for the adjustment of the valve lift, for example by means of an adjustment of an eccentric, than for an adjustment of the support body. A further advantage is a reduction of the structural expenditure and of the components required for a valve train for internal combustion engines.

Further advantageous embodiments are described in the subclaims and are explained in the description together with their effects.

Figure 1:
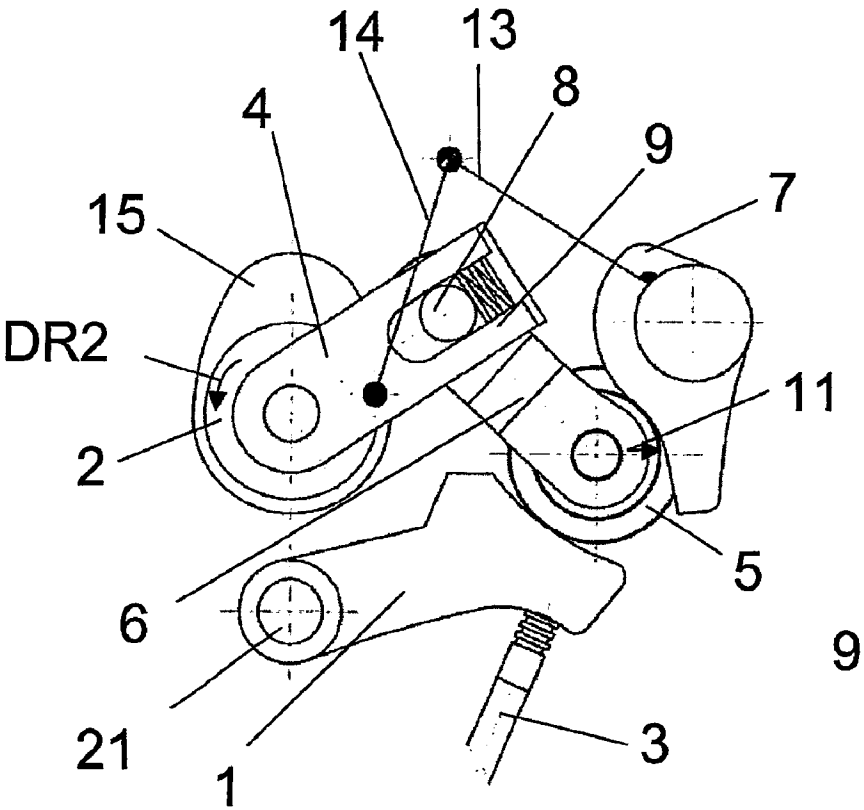
Figure 3:
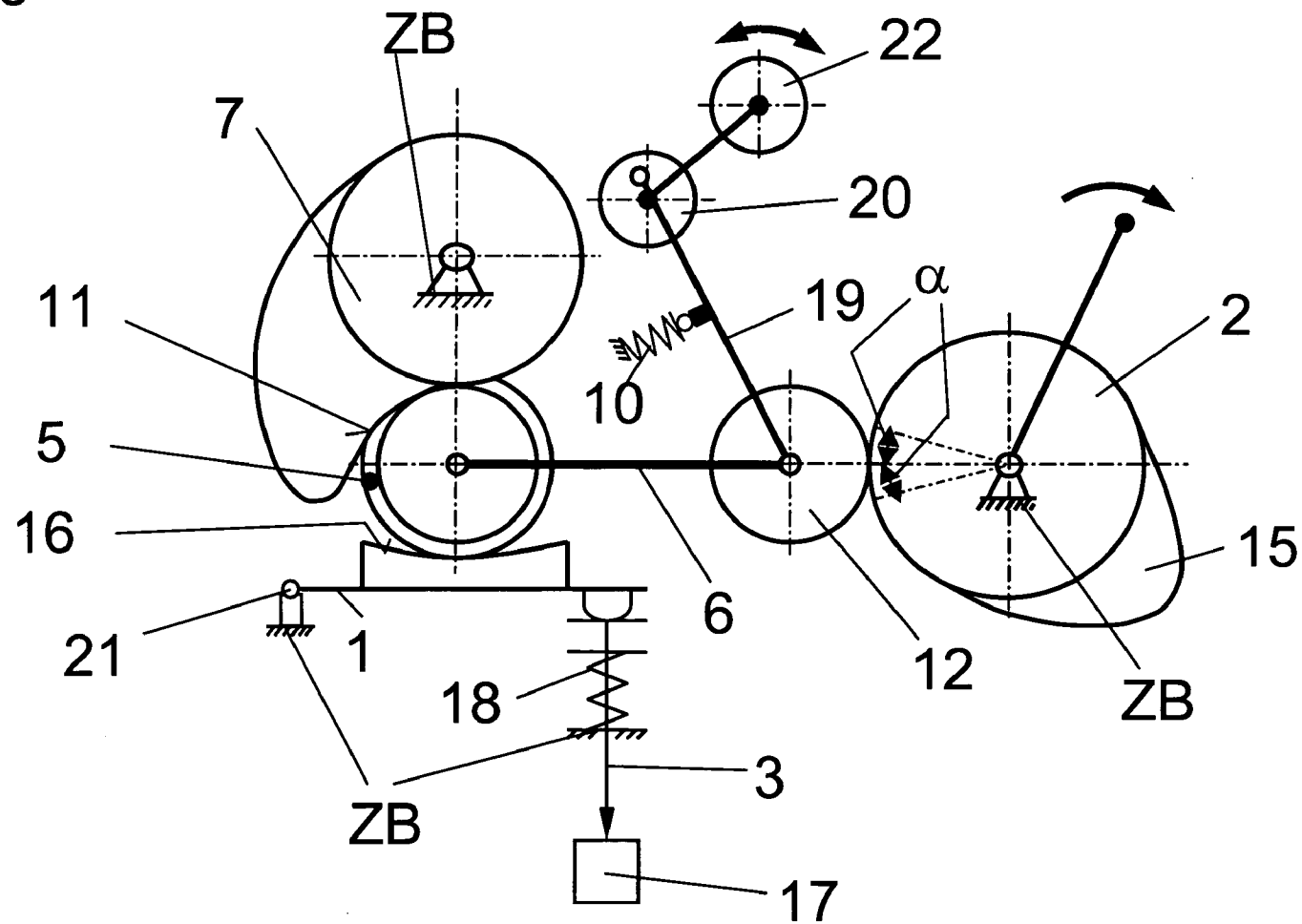
Figure 4:
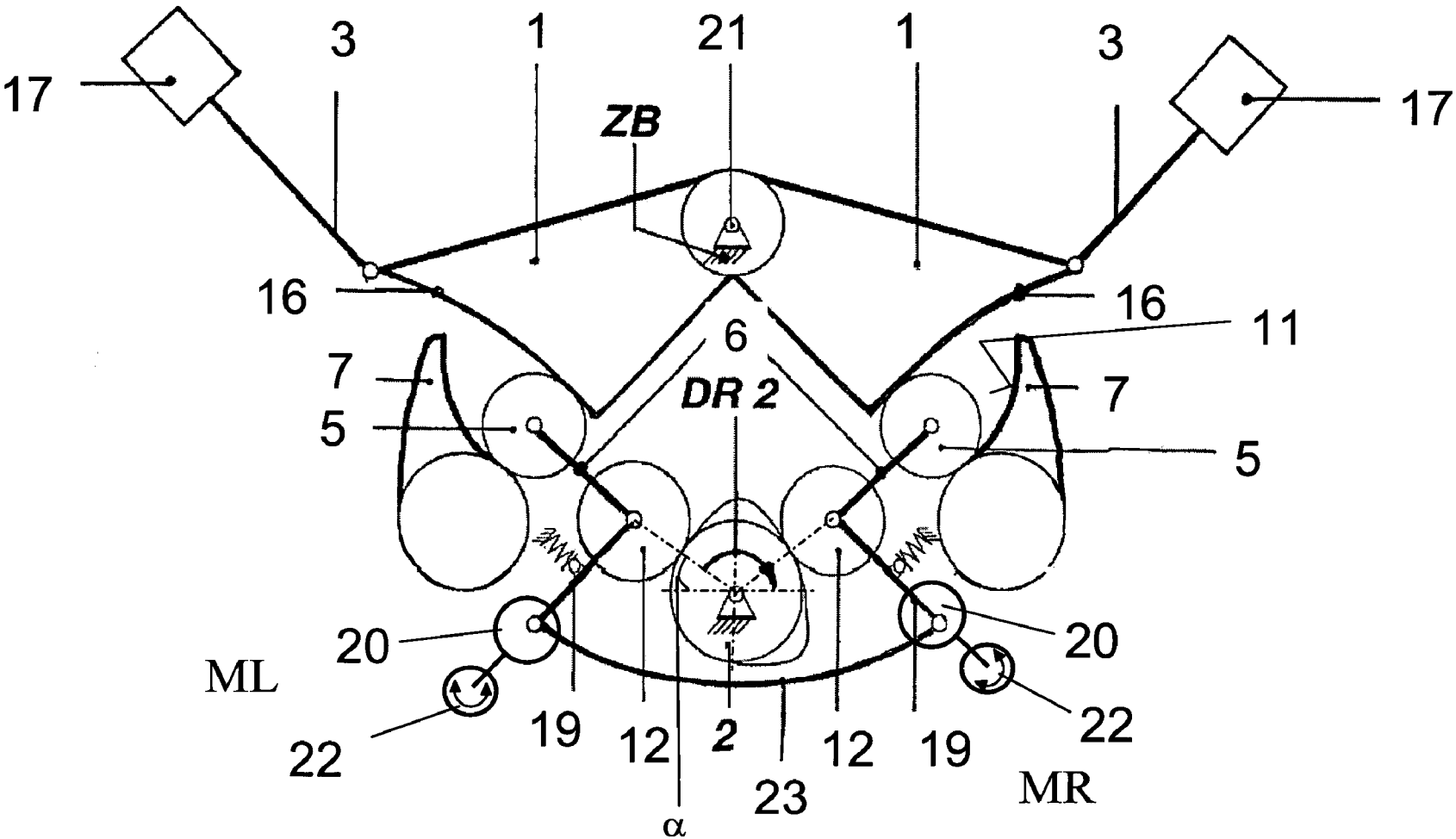

The invention is described in more detail in the following on the basis of exemplary embodiments and with reference to drawings. In the associated drawings:

FIG. 1: is a schematic illustration of the valve train according to the invention with a camshaft situated above a pivoting lever, as per the first variant, FIG. 2: shows an embodiment of the valve train according to the invention as per the first variant, FIG. 3: shows a second variant of a variable valve train in a schematized illustration, in which the maximum valve lift is reached during a cycle of the cam, and FIG. 4: is a highly schematized illustration of an embodiment of the second variant of the valve train according to the invention for the advancement and retardation of the valve opening with low valve lift.

The valve train according to the invention is illustrated in FIGS. 1 and 2 in a first variant, and in FIGS. 3 and 4 in a second variant. In the two different variants, the same reference symbols have been used for identical components.

FIG. 1 illustrates the valve train according to the invention for actuating in particular the inlet valves of an internal combustion engine. The solution according to the invention can also be used for the outlet valves of an internal combustion engine. The valve train has a camshaft 2 with a cam 15 which, with the interposition of a transmission mechanism, moves a pivoting lever 1 and therefore a valve which can be closed, and is held closed, by spring force. In FIG. 3, the valve actuating mechanism, which is operatively connected by means of a plunger rod 3 to the pivoting lever 1, is illustrated schematically and denoted by 17. Also shown in FIG. 3 is the arrangement of a spring 18, by means of which the valve of the valve actuating mechanism 17 can be closed and is held closed.

In FIG. 1, the camshaft 2 is arranged above the pivoting lever 1 which is mounted in a support bearing 21. FIG. 2 illustrates a valve train for two valves which are to be actuated, wherein the arrangement of the transmission mechanism of the second valve corresponds analogously to that of the first, and is not illustrated.

The transmission mechanism which is operatively connected to the cam 15 and the pivoting lever 1 is composed, in both variants, of a transmission member 6 which is in engagement at one end with the cam 15 of the camshaft 2 by means of a roller 12, and at the other end with a control curve 11 of the support body 7 arranged on the cylinder head, and with the pivoting lever 1, by means of a roller 5. Here, the roller 5 which is illustrated in the figures is stepped, with the larger diameter of the roller 5 being operatively connected to the pivoting lever 1 and the smaller diameter being operatively connected to the control curve 11 of the support body 7. It is also possible to arrange two different-sized rollers on the transmission member 6 which engage correspondingly with the pivoting lever 1 and the control curve 11. In a further embodiment which is not illustrated, the roller 5 actuates two pivoting levers 1, which are situated adjacent to one another, for a further valve, for example in an application for a cylinder with two inlet valves.

The contact face 16 on the pivoting lever 1 preferably corresponds in terms of its profile to a radius R about the adjustment axis of the support body 7.

For a variation of the valve lift curve, in which the valve opening time and/or valve closing time are automatically displaced at the same time, the contact point of the roller 12 of the transmission member 6 with the cam 15 is adjusted along the periphery of the cam 15, with simultaneous positive guidance of the cam-side part of the transmission member 6 which is operatively connected by means of the roller 12 to the cam 15. Here, the contact point between the cam 15 and the roller 12 is adjusted by being pivoted about the camshaft 2. As a result of the displacement of the transmission member 6, the contact point between the roller 5 and the control curve 11 of the support body 7 is simultaneously displaced. One adjustment device and one adjusting movement therefore serve to simultaneously displace the contact point between the roller 12 of the transmission member 6 and the cam 15 along the periphery of the cam 15, and the contact point between the roller 5 of the transmission member 6 and the control curve 11 of the support body 7.

According to variant one, a slotted link 4 is arranged, so as to be pivotable about the camshaft 2, as an adjustment device for displacing the transmission member 6, which slotted link 4 is provided with a guide 9 for positively guiding the cam-side end of the transmission member 6. A pin 8 (or roller or sliding block—not illustrated) is fixedly arranged on the transmission member 6 in the region of engagement with the cam 15, said pin 8 being guided in a longitudinally moveable fashion in the guide 9 which is formed as an elongated hole.

In order to ensure permanent contact of the roller 12 of the transmission member 6 with the contour of the cam 15, a spring 10 is arranged on the transmission member 6, which spring 10 is embodied as a pressure spring, is supported on the slotted link 4 and acts on the pin 8.

The pivoting of the slotted link 4, which is mounted on the camshaft 2, for varying the valve lift curve is provided either by means of a separate drive (not illustrated), whose pinion is in engagement with a toothing arranged on the periphery of the slotted link 4, or by coupling the slotted link 4 to a pivotable support body 7 which is arranged on the cylinder head. Here, the pivotable support body 7 is connected by means of a lever 13 and an intermediate member 14 to the slotted link 4, with the lever 13 being fixedly connected to the slotted link 4, and the connection between the lever 13 and the intermediate member 14 and the connection between the intermediate member 14 and the slotted link 4 being in each case articulated relative to one another.

By pivoting the support body 7 illustrated in FIG. 1 clockwise, the slotted link 4 is pivoted by means of the lever 13 and the intermediate member 14 anti-clockwise, resulting in the valve lift being adjusted in the direction of maximum lift height. As a result of the positive guidance of the transmission member 6 in the guide 9 by the pin 8, the valve closing time is automatically displaced towards a later position during the adjustment from a minimum to a maximum lift. Here, the rotational direction DR2 of the camshaft 2 is denoted in FIG. 1 by an arrow. The adjustment from a maximum to a minimum lift takes place analogously, with the support body 7 being pivoted anti-clockwise. At the same time, in addition, the outlet is closed earlier. The phase position of the valve lift maximum is therefore adjusted in a manner coupled to the variation of the valve closing time and of the valve lift height.

The slotted link 4 is mounted either directly on the camshaft 2 or separately in the housing of the cylinder head or block ZB.

When using the valve train according to the invention for the outlet valves of an internal combustion engine, an adjustment in the direction of a higher valve lift causes an earlier opening of the outlet valve.

One variant of the solution according to the invention provides that the slotted link 4 can, as described above, be adjusted by means of a separate drive. Here, the support body 7 with the control curve 11 can be fixedly arranged on the cylinder head. Here, there is no connection of the support body 7 to the transmission member 6 by means of the lever 13 and the intermediate member 14. The control curve 11 can be designed such that, if the control curve 11 is stationary and the slotted link 4 pivots, both the lift height and the valve opening time and/or valve closing time are varied.

In a further variant, it is also possible for the support body 7 to be arranged on the cylinder head such that it is also pivotable in the event of a separate adjustment of the slotted link 4 by means of the drive 7, as a result of which the engagement of the roller 5 with the control curve 11 is varied and the valve lift curve can therefore likewise be varied. Here, the adjustment of the support body 7 can take place independently of the displacement of the slotted link 4 about the camshaft 2.

FIG. 2 illustrates a slotted link 4 for a double-acting pivoting lever 1, which serves to actuate two valves on different sides of the camshaft 2. For simplicity, only the guide 9 of the slotted link 4 is illustrated here. Here, the camshaft 2 is provided with two cams 15 (second cam not illustrated), with in each case one cam 15 being operatively connected to in each case one roller 12 of the respective transmission member 6. It is possible here for the contours of the two cams 15 to be of different design, so that the respective valves have different lift curves. It is for example possible for an inlet valve and an outlet valve to be adjusted in a coupled fashion, with the inlet closing time and the outlet opening preferably being adjusted in a coupled fashion.

FIG. 3 illustrates a variant of the solution according to the invention. Here, the support body 7 with the control curve 11 situated thereon is fixedly arranged on the cylinder block ZB. The transmission member 6 is guided and displaced by means of an adjustment device 20 which is fixedly arranged on the cylinder block ZB and is adjusted by an actuating device 22. The transmission member 6 is displaced by the adjustment device 20, which is for example embodied as an eccentric, a displaceable pin or the like, in interaction with a guide rocker 19 which connects the adjustment device 20 to the transmission member 6.

As a result of the displacement by means of the adjustment device 20, whereby the transmission member 6 and therefore the contact line between the cam 15 and the roller 12 of the transmission member 6 are displaced by the angle $\alpha$ counter to the rotational direction DR2 of the camshaft 2 by means of the guide rocker 19, the valve lift is reduced while the valve lift range is advanced, as already described above with respect to FIG. 1. If, as a result of an adjustment by means of the adjustment device 20, the contact line between the cam 15 and the roller 12 of the transmission member 6 is displaced by an angle $\alpha$ in the rotational direction DR2 of the camshaft 2, the valve opening range is retarded while the valve lift is slightly increased. In both cases, after the beginning of the cam lobe, the roller 5 is in engagement over a greater region with the front part of the control curve 11, in which the valve does not open. FIG. 3, however, illustrates the case in which a maximum valve lift is obtained during a cycle of the cam 15. The scope for adjustment of the contact point of the roller 12 relative to the camshaft 2 about the angle a is schematically illustrated in FIG. 3.

Here, in order to ensure permanent contact of the roller 12 of the transmission member 6 with the contour of the cam 15, the spring 10 is arranged on the guide rocker 19. The spring 10 is likewise embodied as a pressure spring and is supported on the cylinder block ZB.

The pivoting lever 1 according to variant two can also be formed to be single-acting or double-acting, wherein in the case of a double-acting pivoting lever 1, each pivoting lever side is operatively connected by means of in each case one roller 5 to the associated transmission member 6 and the control curve 11, and by means of the guide rocker 19 to an adjustment device 20.

FIG. 4 is a highly schematized illustration of an embodiment of variant two of the valve train according to the invention for internal combustion engines having cylinder banks which are arranged in a V-shape, and having a camshaft 2 which is arranged in the V-angle of the cylinder banks, in which illustration the mechanisms MR and ML arranged on the right-hand and left-hand sides of the camshaft 2 correspond entirely to the embodiment of FIG. 3.

The support bodies 7 are fixedly arranged on the cylinder block ZB and are each provided with a control curve 11 for setting the valve lift. The adjustment of the valve lift with an automatic advancement or retardation of the valve opening range is carried out by means of an adjustment device 20, which is arranged in each case on the two guide rockers 19. The adjustment by means of the adjustment device 20 on both sides is carried out by the respectively assigned actuating device 22 in opposite actuating directions, but always synchronously with regard to the adjustment to the maximum or minimum valve opening range. The two guide rockers 19 of the right-hand and left-hand sides are connected to one another by means of a coupling bar 23.

It is however also conceivable, in order to set the lift while simultaneously automatically displacing the valve opening range, for an adjustment device 20 with an associated actuating device 22 to be arranged on a guide rocker 19 at only one side of the camshaft 2. The adjustment of the other side takes place via the coupling bar 23. Here, the adjustment device 20 can be an eccentric, a displaceable pin or the like.

The displacement of the guide rockers 19 by means of the adjustment device 20 results, as already described, in the point of engagement of the roller 12 of the transmission member 6 being displaced relative to the cam 15 of the camshaft 2, and in the point of engagement of the roller 5 being displaced relative to the support curve or the control curve 11 of the support body 7. Said displacement results in a variation of the valve lift (lift magnitude) with a simultaneous automatic displacement of the valve opening range.

The invention claimed is:

1. A valve train for internal combustion engines having at least one camshaft and having valve actuating elements, arranged in the cylinder head, for one or more valves of each cylinder, with the valve actuating elements being in engagement with a cam by means of a pivoting lever which is mounted in a directly or indirectly positionally fixed manner in the cylinder block or cylinder head and in each case by means of a transmission member which is guided on a support body, with the transmission member being guided at the cam side, wherein in order to vary the valve lift curve, the contact point between the transmission member and the cam along the periphery of the cam, and the contact point between the transmission member and a control curve of the support body, with simultaneous positive guidance of that part of the transmission member which is operatively connected to the cam, are adjustable by displacing the transmission member relative to the camshaft.

2. The valve train according to claim 1, wherein the contact point between the contour of the cam and the transmission member is pivotable about the camshaft.

3. The valve train according to claim 1, wherein the transmission member is operatively connected to the contour of the cam by means of a roller.

4. The valve train according to claim 1, wherein the transmission member is in engagement, by means of a roller, with a control curve arranged on a support body and with the pivoting lever.

5. The valve train according to claim 1, wherein the pivoting lever has a contact face for that roller of the transmission member which is in engagement with the control curve arranged on the support body and with the contact face of the pivoting lever, wherein the contact face is formed in terms of its profile as a radius about the center of rotation of the support body.

6. The valve train according to claim 1, wherein the camshaft is arranged above or below the pivoting lever.

7. The valve train according to claim 1, wherein, in order to displace the transmission member, a cam-side guide of the transmission member can be adjusted relative to the camshaft.

8. The valve train according to claim 7, wherein a cam-side guide of the transmission member is pivotable about the camshaft.

9. The valve train according to claim 1, wherein a pivotable slotted link is arranged around the camshaft, which slotted link is provided with at least one guide for longitudinally moveably holding a pin which is fixedly connected to the transmission member a roller or a sliding block.

10. The valve train according to claim 9, wherein the at least one guide in the slotted link for holding the pin which is fixedly connected to the transmission member is formed as an elongated hole.

11. The valve train according to claim 9, wherein the pivoting lever is designed to be single-acting or double-acting, wherein in the case of a double-acting pivoting lever, each pivoting lever side is operatively connected by means of in each case one roller to the associated transmission member and the control curve, and by means of the pin to in each case the at least one guide of a pivotable slotted link.

12. The valve train according to claim 1, wherein the support body is fixedly or pivotably connected to the cylinder block or cylinder head.

13. The valve train according to claim 9, wherein the slotted link is mounted on the camshaft or in the housing of the cylinder head or block.

14. The valve train according to claim 9, wherein the slotted link has a second guide for a further transmission member for actuating a further valve.

15. The valve train according to claim 9, wherein the slotted link and the pivotable support body are articulatedly connected to one another by means of a lever and an intermediate member, with either the lever being fixedly arranged on the support body or the intermediate member being fixedly arranged on the slotted link, while other connecting points are held so as to be articulated relative to one another.

16. The valve train according to claim 9, wherein, in order to pivot the pivotable slotted link, a separate drive is provided whose pinion is in engagement with a toothing arranged on the periphery of the slotted link.

17. The valve train according to claim 1, wherein, in order to displace the transmission member relative to the camshaft, a positionally fixed adjustable adjustment device is provided which is connected by means of a guide rocker to the transmission member.

18. The valve train according to claim 17, wherein the support body is fixedly arranged on the cylinder block.

19. The valve train according to claim 17, wherein the adjustment device is embodied as an eccentric or a displaceable pin.

20. The valve train according to claim 17, wherein, for the purpose of adjustment, the adjustment device is connected to an actuating device.

21. The valve train according to claim 17, wherein the pivoting lever is designed to be single-acting or double-acting, wherein in the case of a double-acting pivoting lever, each pivoting lever side is operatively connected by means of in each case one roller to the associated transmission member and the control curve, and by means of the guide rocker to the adjustment device.

22. The valve train according to claim 21, wherein the guide rocker of one side is coupled by means of a coupling bar to the guide rocker of the other side.

23. The valve train according to claim 21, wherein the adjustment device with an actuating device is arranged on a guide rocker at only one side of the camshaft.

* * * * *